US011643177B2

(12) United States Patent
Ripplinger et al.

(10) Patent No.: US 11,643,177 B2
(45) Date of Patent: May 9, 2023

(54) FACILITATING SEARCH AND RESCUE

(71) Applicant: Battle Sight Technologies, LLC, Dayton, OH (US)

(72) Inventors: Nicholas R. Ripplinger, Springboro, OH (US); Christopher J. Vogt, Cincinnati, OH (US)

(73) Assignee: Battle Sight Technologies, LLC, Dayton, OH (US)

( * ) Notice: Subject to any disclaimer, the term of this patent is extended or adjusted under 35 U.S.C. 154(b) by 0 days.

(21) Appl. No.: 17/697,335

(22) Filed: Mar. 17, 2022

(65) Prior Publication Data

US 2022/0204146 A1 Jun. 30, 2022

Related U.S. Application Data

(63) Continuation of application No. 17/005,530, filed on Aug. 28, 2020, now Pat. No. 11,352,107.

(60) Provisional application No. 62/904,757, filed on Sep. 24, 2019.

(51) Int. Cl.
*B63C 9/20* (2006.01)

(52) U.S. Cl.
CPC ..... *B63C 9/20* (2013.01)

(58) Field of Classification Search
CPC ..... B63C 9/20
See application file for complete search history.

(56) References Cited

U.S. PATENT DOCUMENTS 6,115,873 A * 9/2000 Dunkley ..... A45D 34/04 15/210.1
7,976,727 B1 * 7/2011 Naik ..... C09K 11/623 252/301.4 R
9,866,369 B1 * 1/2018 Haynes ..... H04L 7/0037
2002/0087184 A1 * 7/2002 Eder ..... A61B 17/1215 606/191
2011/0255303 A1 * 10/2011 Nichol ..... G02B 6/0053 362/606
2016/0272287 A1 * 9/2016 Covelli ..... G01S 19/17

OTHER PUBLICATIONS

U.S. Appl. No. 17/147,527, entitled "Using Illuminable Dyes to Facilitate Search and Rescue", filed Jan. 13, 2021.

* cited by examiner

*Primary Examiner* — S. Joseph Morano
*Assistant Examiner* — Jovon E Hayes
(74) *Attorney, Agent, or Firm* — Thomas E. Lees, LLC

(57) ABSTRACT

An apparatus that facilitates search and rescue, for example, in open water. The apparatus comprises a substrate with a particular geometry and a perimeter. The apparatus further comprises a cover positioned atop the substrate with the cover also having a particular geometry and perimeter, which correspond to the geometry and perimeter of the substrate. An air-tight seal seals the substrate perimeter to the cover perimeter and creates a sealed internal region. A breakable vessel holding an activator is located in the sealed internal region, along with illuminable dyes that are also located in the sealed internal region. When the breakable vessel is broken, the activator reacts with the illuminable dyes and illuminates the illuminable dyes.

6 Claims, 10 Drawing Sheets

FACILITATING SEARCH AND RESCUE

CROSS REFERENCE TO RELATED APPLICATIONS

This application is a continuation of U.S. patent application Ser. No. 17/005,530, filed 2020 Aug. 28, by Applicant Battle Sight Technologies, LLC, and having the title "FACILITATING SEARCH AND RESCUE," which claims the benefit of U.S. Provisional Patent Application Ser. No. 62/904,757, filed Sep. 24, 2019, and having the title "FACILITATING SEARCH AND RESCUE," the disclosures of which are hereby incorporated by reference as if expressly set forth in their entireties.

STATEMENT REGARDING FEDERALLY SPONSORED RESEARCH OR DEVELOPMENT

This invention was made with government support under FA 8652-19-P-WI13 awarded by the Department of Defense (Department of the Air Force, Air Force Materiel Command). The government has certain rights in the invention.

BACKGROUND

Field of the Disclosure

The present disclosure relates generally to search and rescue. More particularly, the present disclosure relates to maritime search and rescue.

Description of Related Art

Many hazards face individuals that are lost at sea or in other open water. The chances of survival diminish rapidly with time and, thus, there is a need to quickly find and rescue those that are in open water.

SUMMARY

An apparatus that facilitates search and rescue, for example, in open water. The apparatus comprises a substrate with a particular geometry and a perimeter. The apparatus further comprises a cover positioned atop the substrate with the cover also having a particular geometry and perimeter, which correspond to the geometry and perimeter of the substrate. An air-tight seal seals the substrate perimeter to the cover perimeter and creates a sealed internal region. A breakable vessel holding an illuminable dye located in the sealed internal region, along with an activator that is also located in the sealed internal region. When the breakable vessel is broken, the illuminable dye reacts with the activator and illuminates the illuminable dye.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1:
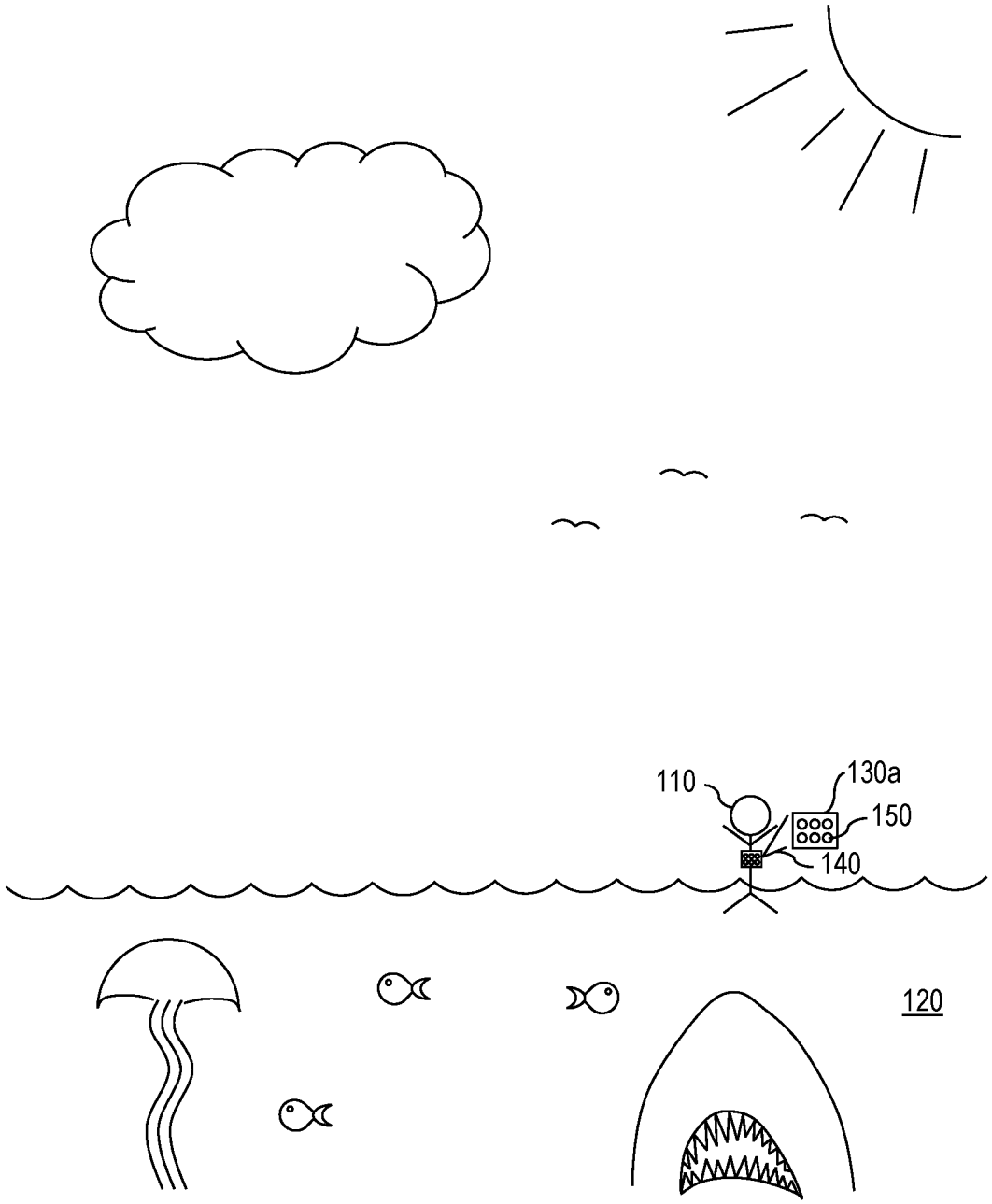
FIG. 1 is a diagram showing an individual with one embodiment of an apparatus that facilitates search and rescue in open water.

Search and rescue operations take place in many different environments, with each environment presenting its own challenges. For those that are lost in open water (e.g., large lakes, seas, oceans, etc.), the hazards include hostile temperatures, dangerous marine animals, and tumultuous waves. Thus, it is not surprising that the chances of survival diminish rapidly over time. Because of this, there is a need to quickly find and rescue those that are in open water.

To facilitate maritime search and rescue operations (or other open-water-based search and rescue operations), the present disclosure provides an illuminable dye and an activator. Either the illuminable dye or the activator is positioned at select locations so that, when activated, the illuminable dye becomes luminescent. The apparatus has a geometry that, when released in open water, allows the apparatus to spread to a sufficiently large area, such that the apparatus becomes visible from a distance of at least six hundred meters (600 m) and, more preferably, at least 1.5 kilometers (km). The activator (or dye) is placed at select locations in the apparatus so as to maximize visibility during search and rescue operations. For some embodiments, once the apparatus begins to luminesce, it becomes detectable using drones, space-based assets (e.g., satellites), or other un-manned vehicles.

Having provided a broad technical solution to a technical problem, reference is now made in detail to the description of the embodiments as illustrated in the drawings. While several embodiments are described in connection with these drawings, there is no intent to limit the disclosure to the embodiment or embodiments disclosed herein. On the contrary, the intent is to cover all alternatives, modifications, and equivalents.

FIGS. 1, 2, 3, and 4 are diagrams showing one embodiment of an apparatus that facilitates search and rescue in open water; FIGS. 5A and 5B (collectively, FIG. 5) show another embodiment of an apparatus that facilitates search and rescue in open water; and FIGS. 6A, 6B, 6C, and 6D (collectively, FIG. 6) show yet another embodiment of an apparatus that facilitates search and rescue in open water.

With this in mind, FIG. 1 shows an individual 110 that is lost in open water 120, which creates a large risk is hypothermia (if the water is cold) or drowning (if the waters are choppy or tumultuous). In addition to hypothermia and drowning, the individual 110 can be exposed to other hazards, such as, for example, flailing injuries to limbs and internal injuries from impacts (e.g., ejection from an aircraft, crash-related impacts, etc.). Additionally, the individual 110 can sometimes be surrounded by dangerous marine animals, such as, for example, stinging jellyfish or sharks. Furthermore, if the individual 110 is in an area that is teeming with fish, then the fish can also attract other predatory animals. Thus, a speedy rescue increases the chances of survival for an individual 110 in open water 120.

As shown in FIG. 1, a sealed bag 130*a* is attached to the individual 110 via a tether 140. As shown with reference to FIGS. 2, 3, and 4, the bag 130*a* includes a mesh 150 and an illuminable dye 210. For some embodiments, the illuminable dye 210 is a chemiluminescent dye, which requires an activator. For other embodiments, the dye 210 is a bioluminescent dye. Preferably, the dye 210 is located in one or more breakable vessels (e.g., breakable ampules, crushable beads, etc.), thereby providing some level of control to the individual 110 on when to activate the illuminable dye 210. By way of example, the illuminable dye 210 can be an oil-based dye or a dye comprising an organic solvent, such as, for example, dibutyl phthalate, dimethyl phthalate, dioctyl phthalate, butyl benzoate, ethyl benzoate, tert-butyl alcohol, tributyl citrate, triethyl citrate, dioctyl adipate, didecyl adipate, or ditridecyl adipate. Alternatively, if the illuminable dye 210 is impregnated in the mesh 150, then the activator is located in one or more breakable vessels. The activator can be an oxidant, such as, for example, sodium percarbonate, hydrogen peroxide, bromine, bromates, chlorinated isocyanurates, chlorates, chromates, dichromates, hydroperoxides, hypochlorites, inorganic peroxides, ketone peroxides, nitrates, nitric acid, nitrites, perborates, perchlorates, perchloric acid, periodates, permanganates, peroxides, peroxyacids, persulphates, or other oxidizers. For illustrative purposes, the embodiment with the activator-impregnated mesh is described in greater detail. However, it should be appreciated that the description is equally applicable to the embodiment with the dye-impregnated mesh.

For some embodiments, the mesh 150 is a net with vertical strands, horizontal strands that intersect the vertical strands, and one or more sponges 310*a* . . . 310*n* (collectively 310) or other absorbent material at select intersections of the vertical and horizontal strands. The activator can be impregnated in the sponges 310 or, in the alternative, impregnated directly in the mesh 150. It should be appreciated that the sponges 310 can be secured to the mesh 150 in various ways, such as, for example, by heat pressing the sponges 310 to the mesh 150. For other embodiments, the sponges 310 are secured to the mesh 150 by bonding, gluing, stapling, stitching, or other known means. It should also be appreciated that, in addition to or in lieu of the horizontal and vertical strands that form square-shaped or rectangular-shaped net cells, other geometric strand designs can be used, such as, for example, rhombus-shaped net cells, parallelogram-shaped net cells, triangle-shaped net cells, etc.

Figure 2:
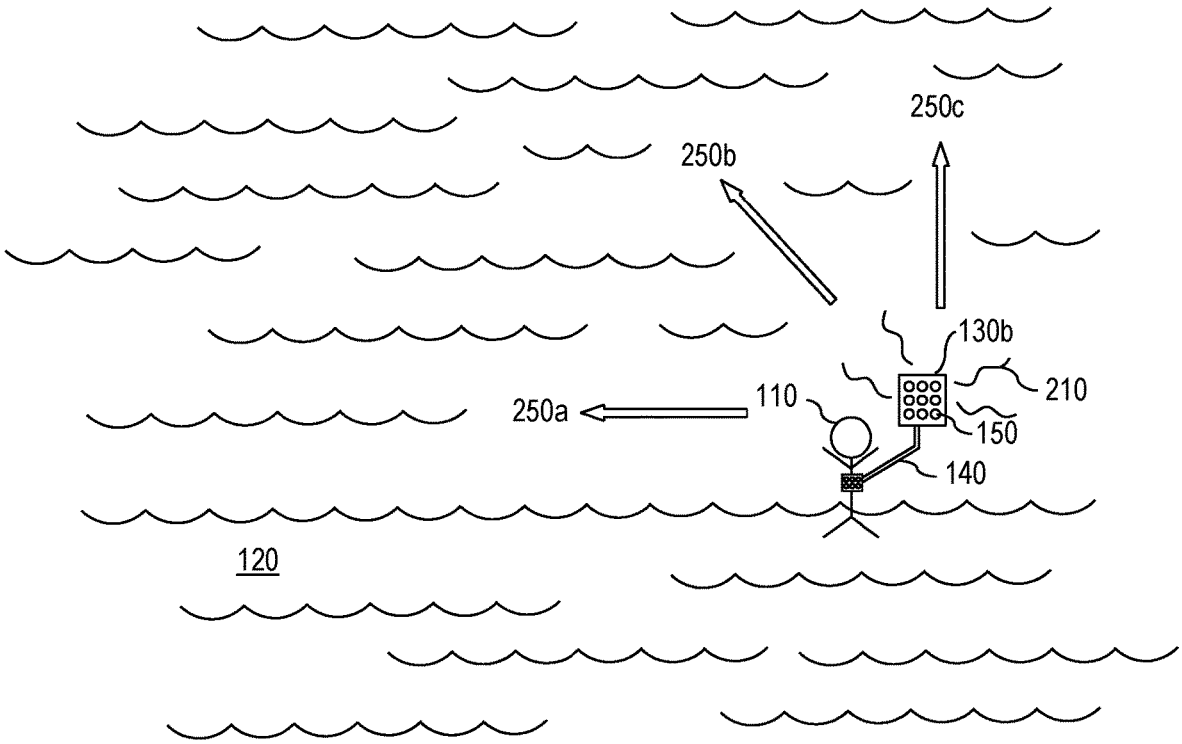
FIG. 2 is a diagram showing one embodiment of the apparatus that facilitates search and rescue shortly after being activated.

In operation, and as shown in FIG. 2, when in the water 120 the individual 110 activates the apparatus by crushing the contents of bag 130*a*, thereby releasing the illuminable dye 210 to interact with the activator, which is impregnated in the sponges. This interaction illuminates the dye 210, thereby making the dye 210 more visible.

Upon activation of the dye 210, the individual 110 tears open the sealed bag 130*a* and the torn bag 130*b* releases its contents (including the now-activated dye 210) to the water 120. For some embodiments, the apparatus includes a rip-cord that facilitates tearing of the bag 130. For other embodiments, pressurized deployment mechanisms (e.g., compressed air, etc.) are used to release the contents of the bag 130. Because of the movement of the water 120, the released contents (including the dye 210) spread outwardly in all directions 250*a* . . . 250*c* (collectively 250). However, because the activator is impregnated at various locations in the mesh 150 (and hence the illuminated segments are located correspondingly in the mesh 150), the spread of the now-illuminated dye 210 will be controlled and somewhat limited, based on the absorbency of the sponges 310 or the absorbency of the mesh 150.

Figure 3:
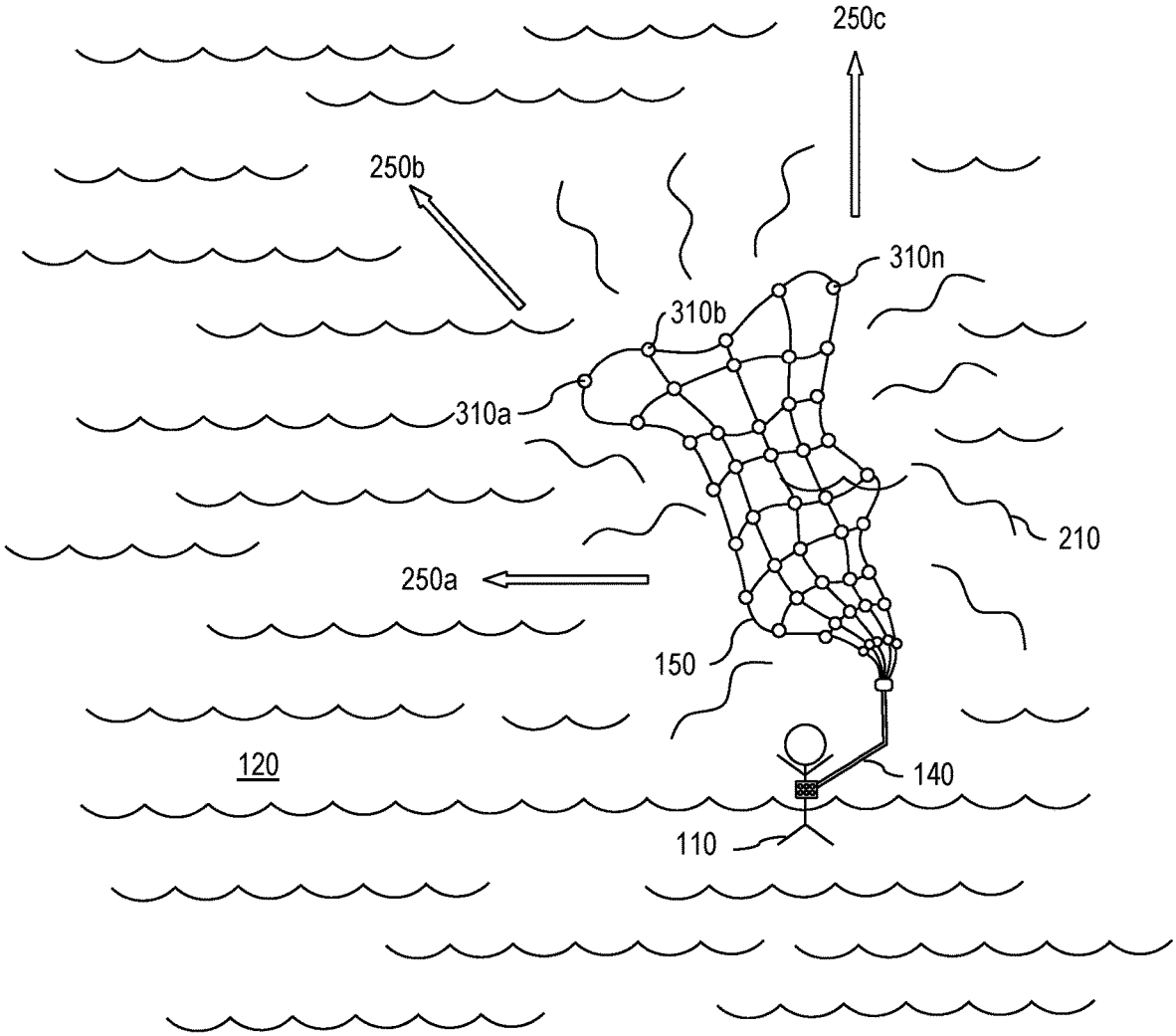
FIG. 3 is a diagram showing one embodiment of the apparatus that facilitates search and rescue at a later time after being activated.

As shown in FIG. 3, the mesh 150 continues to spread in all directions 250 and continues to release the dye 210 into the water 120. The released dye 210 provides a luminescent glow in the water 120 surrounding the individual 110, thereby vastly increasing the visibility of the individual 110 in the water 120. Additionally, because the activator (and thus the illuminated section) is impregnated in the sponges 310 (or the mesh 150), the visibility of the mesh 150 increases in proportion to the area that the mesh 150 occupies, as the mesh 150 continues to expand in all directions 250.

Figure 4:
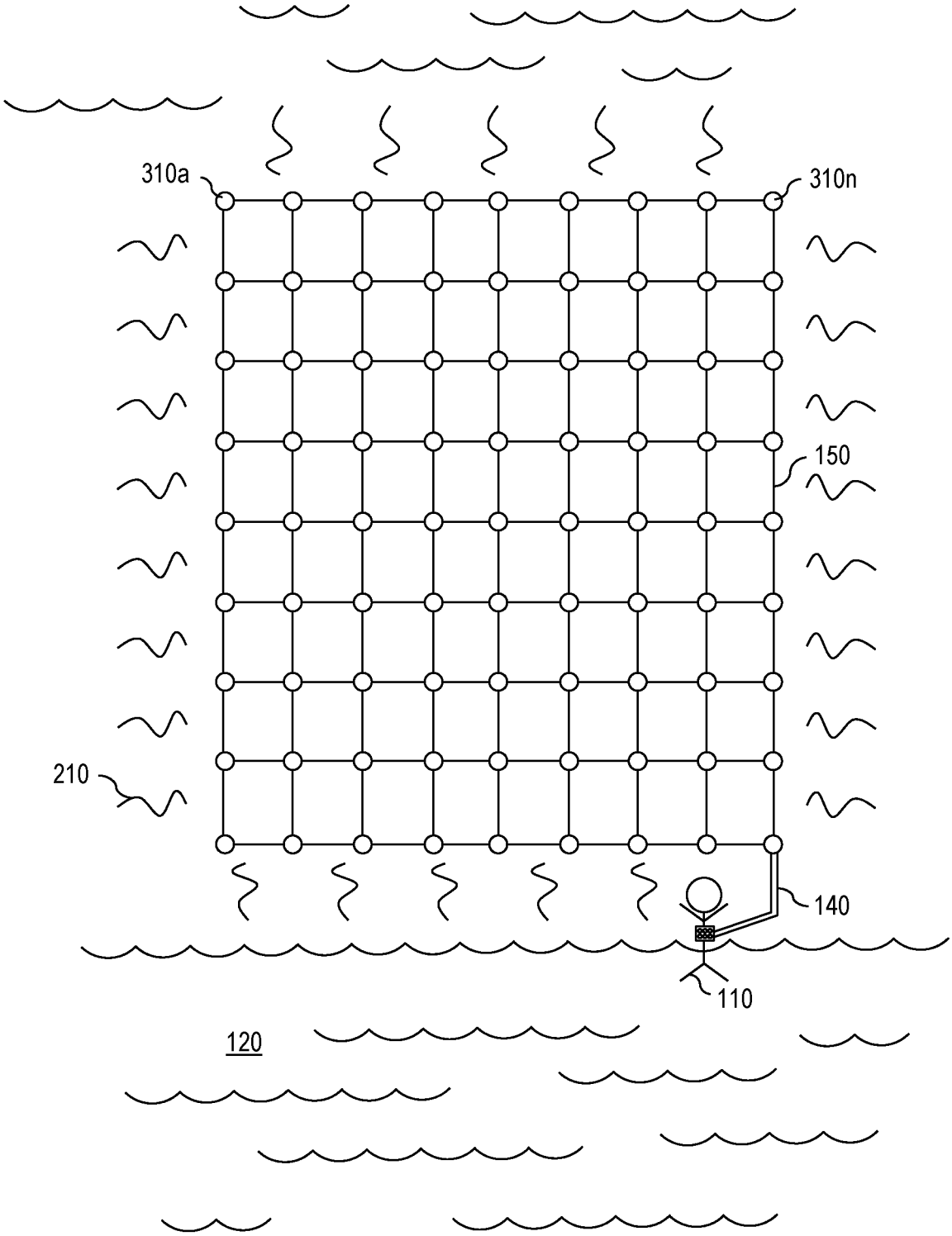
FIG. 4 is a diagram showing one embodiment of the apparatus that facilitates search and rescue at a point in time when the apparatus is (nearly) fully deployed.
Figure 5A:
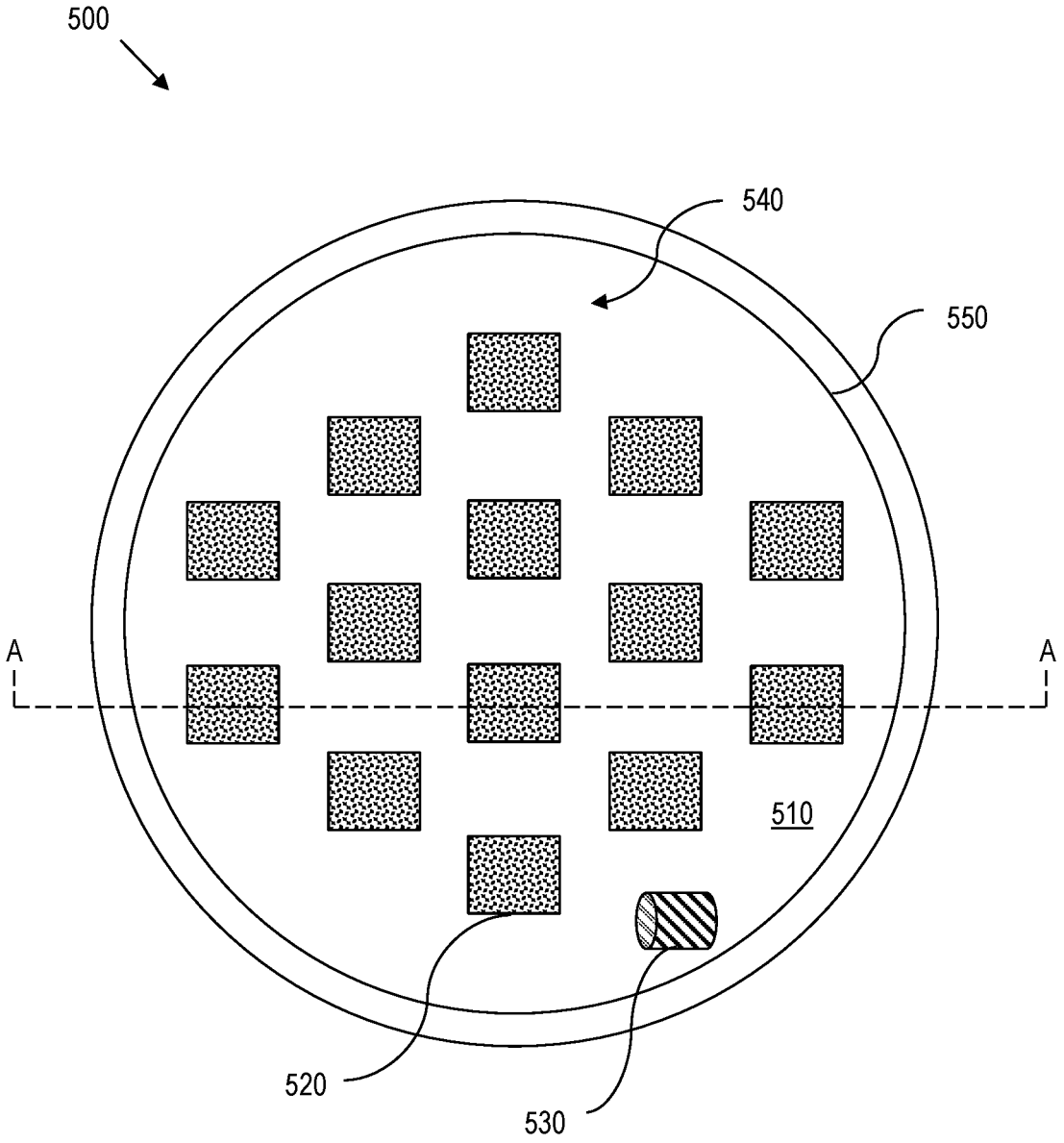
FIG. 5A is a diagram showing a top view of another embodiment of an apparatus that facilitates search and rescue.
Figure 5B:
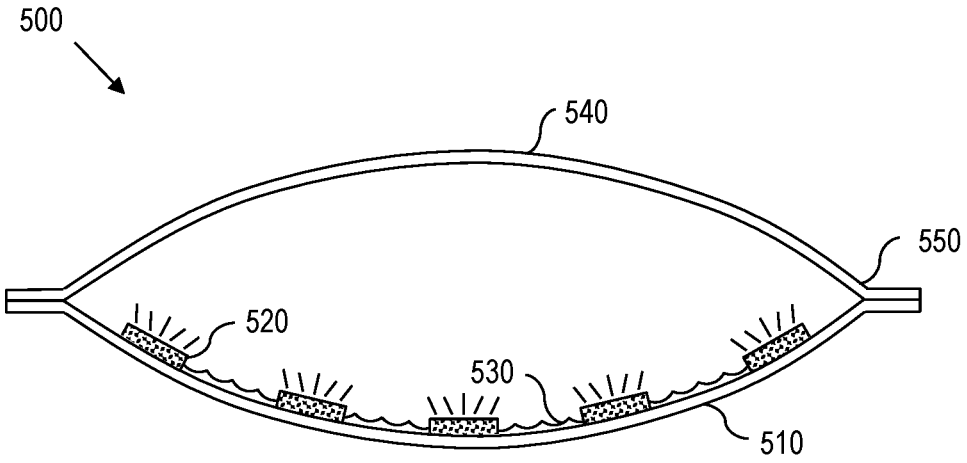
FIG. 5B is a diagram showing a side cut-away view of the apparatus of FIG. 5A upon deployment of the apparatus.

Continuing to FIG. 4, when the mesh 150 is fully expanded on the surface of the water 120, the mesh 150 creates a large, luminescent area with the sponges 310 exhibiting bright spots and the continued (but slow) release of dye 210 increasing the illuminated area on the surface of the water. For some embodiments, the mesh 150 is a net having a ten-meter (10 m) length and a one-meter (1 m) width, thereby making it a long and narrow tail that extends away from the individual 110. However, it should be appreciated that other configurations for the mesh 150 can be implemented, for example, a square-shaped mesh, a rectangular-shaped mesh, a circular mesh, etc., and the specific dimensions of the mesh 150 can be increased or decreased as needed.

It should be recognized that the dye 210 diffuses on the surface of the water 120 and, thus, loses its brightness with continued diffusion. However, because the activator (or dye 210) is impregnated into sponges 310 on the mesh 150 (or on the mesh 150 itself), the surface area of the water 120 that is covered by the mesh 150 will continue to illuminate until the illuminable dye 210 loses its luminescence. For chemiluminescent dyes, this point will be when the dye 210 and the activator have neared the end of their chemical reaction.

Although the embodiment of FIGS. 1 through 4 (designated for convenience as a net embodiment) function adequately in calm waters, it is possible that turbulent or choppy waters will dissipate the luminescent dyes much faster and, therefore, reduce the effectiveness of the net embodiment. To mitigate the effects of fast dissipation, the chemically active components can be isolated from the open waters, as shown in the embodiments of FIGS. 5A through 6D.

Turning now to FIGS. 5A and 5B, shown are both a top view (FIG. 5A) and a side view (FIG. 5B) of one embodiment of an environmentally isolated apparatus 500 that facilitates search and rescue (designated for convenience as a balloon embodiment 500). As shown in FIGS. 5A and 5B (collectively, FIG. 5), the balloon embodiment 500 comprises a bottom substrate 510 that is substantially impermeable to water. Some embodiments of the bottom substrate 510 comprise reflective material. Also, for some embodiments, the bottom substrate 510 is substantially circular and has a diameter of between approximately fifty (50) centimeters and approximately two (2) meters. It should be appreciated that the bottom substrate 510 can be any geometric shape with a substantially equivalent surface area to that of a circular embodiment.

Next, several activators 520 are adhered to the surface of the bottom substrate 510. Preferably, the activators 520 are arranged in a pattern that is readily distinguishable from patterns that occur naturally in open waters (meaning, a non-naturally occurring pattern). Consequently, the pattern allows for potentially faster and easier detection in open waters because it is less likely that the pattern will be mistaken for a naturally occurring reflection or naturally occurring luminescence.

The balloon embodiment 500 also comprises an encased dye pack 530, which can be broken to release an illuminable dye that is contained therein. It should be appreciated that the activators 520 can also be arranged in a pattern that maximizes saturation or activation by the dye pack 530. Preferably, the arrangement pattern of the activators 520 in the balloon embodiment strikes a balance between optimized saturation and optimized visibility.

The bottom substrate 510 is covered with a transparent water-impermeable top 540 and a seal 550 provides an air-tight seal 550 around a periphery of the balloon embodiment 500, thereby isolating the contents of the balloon embodiment 500 from external elements. To the extent that industrial sealing processes (such as those used in mylar balloons), only a truncated discussion of the air-tight seal 550 is provided herein. Prior to activation, the balloon embodiment 500 is substantially flat and can be folded or rolled to occupy a smaller space.

In operation, the balloon embodiment 500 is activated by breaking the dye pack 530, which releases the illuminable dye. A cross-section of the balloon embodiment along the broken line A-A is shown in FIG. 5B. The illuminable dye reacts chemically with the activators 520. For some embodiments, the some of the activators 520 can be coated with a dissolvable coating, thereby allowing different activators 520 to be activated at different times after the release of the illuminable dye. In other words, by applying different time-release coatings to certain activators 520, it is possible to cascade in time the luminescence from one set of activators 520 to another set of activators 520, and so on, based on the rates at which the coatings dissolve.

Continuing, the chemical reaction produces two (2) results. First, the chemical reaction creates a luminescence at a given wavelength. Preferably, the wavelength is in the range of ultraviolet (UV) light, but it should be appreciated that the chemicals can be customized to emit at different wavelengths and for different durations. Second, the chemical reaction releases a gas, which inflates the balloon embodiment 500. As noted above, both the activators 520 and the dye pack 530 are enclosed in the apparatus and sealed from external elements using an air-tight seal 550. Thus, if a gas is released from the chemical reaction, then the released gas inflates the balloon embodiment 500 because the gas cannot escape through the seal 550. By way of example, if the balloon embodiment 500 has a sixty centimeter (60 cm) diameter, then the dye pack 530 contains approximately one hundred milliliters (100 mL) of illuminable dye. Correspondingly, if the balloon embodiment 500 has a 1.5 meter (m) diameter, then approximately 200 mL of dye should suffice. Those having skill in the art can readily calculate the amount of illuminable dye that will be sufficient to react with the pattern of activators 520.

By way of example, if the illuminable dye is an oil-based dye (e.g., dibutyl phthalate, dimethyl phthalate, dioctyl phthalate, butyl benzoate, ethyl benzoate, tert-butyl alcohol, tributyl citrate, triethyl citrate, dioctyl adipate, didecyl adipate, or ditridecyl adipate), and the activator 520 is a hydrogen-containing oxidant (e.g., sodium percarbonate, hydrogen peroxide, bromine, bromates, chlorinated isocyanurates, chlorates, chromates, dichromates, hydroperoxides, hypochlorites, inorganic peroxides, ketone peroxides, nitrates, nitric acid, nitrites, perborates, perchlorates, perchloric acid, periodates, permanganates, peroxides, peroxyacids, persulphates, or other oxidizers), then hydrogen gas is released from the reaction and fills the balloon embodiment 500.

Because the balloon embodiment 500 has an air-tight seal 550, the illuminable dye continues to wash over the activators 520 as the isolated apparatus undulates or jolts with the waves in the water. The continued washing of the activators 520 allows for unreacted activators 520 to be activated by the illuminable dye. In other words, continued movement of the illuminable dye within the balloon embodiment 500 results in a more complete reaction between the illuminable dye and all of the activators 520. The air-tight seal 550 also prevents dissipation of the illuminable dye or the activators 520 in open water because neither the dye nor the activator 520 can escape the balloon embodiment 500. Thus, the balloon embodiment 500 is visible for a longer period than the net embodiment of FIGS. 1 through 4, thereby providing visibility (at a twenty degree (20°) cone of view) from a distance of up to (or greater than) approximately 600 m for some embodiments and up to (or greater than) approximately 1.5 kilometers (km) for other embodiments, depending on the luminescent intensity. For some embodiments, once the balloon embodiment 500 begins to luminesce, it becomes detectable using drones, space-based assets (e.g., satellites), or other un-manned vehicles.

The balloon embodiment 500 can be securely attached to an individual (similar to how the net embodiment of FIGS. 1 through 4 are attached to an individual) or, alternatively, the balloon embodiment 500 can be securely attached to a life raft using, for example, a clip or other type of harness. For such embodiments, it should be appreciated that the balloon embodiment 500 can include a tethering hole to which a tether is secured. Additionally, to prevent capsizing or overturning in turbulent waters, a weight or other know devices to keep the transparent top 540 facing upward (rather than facing toward the water).

In yet another embodiment, emissions from the luminescent materials can be collimated using a parabolic substrate. The parabolic geometry allows for more concentrated or focused emissions of light. The embodiment having a parabolic geometry is shown in greater detail with reference to FIGS. 6A, 6B, 6C, and 6D (collectively, FIG. 6).

Figure 6A:
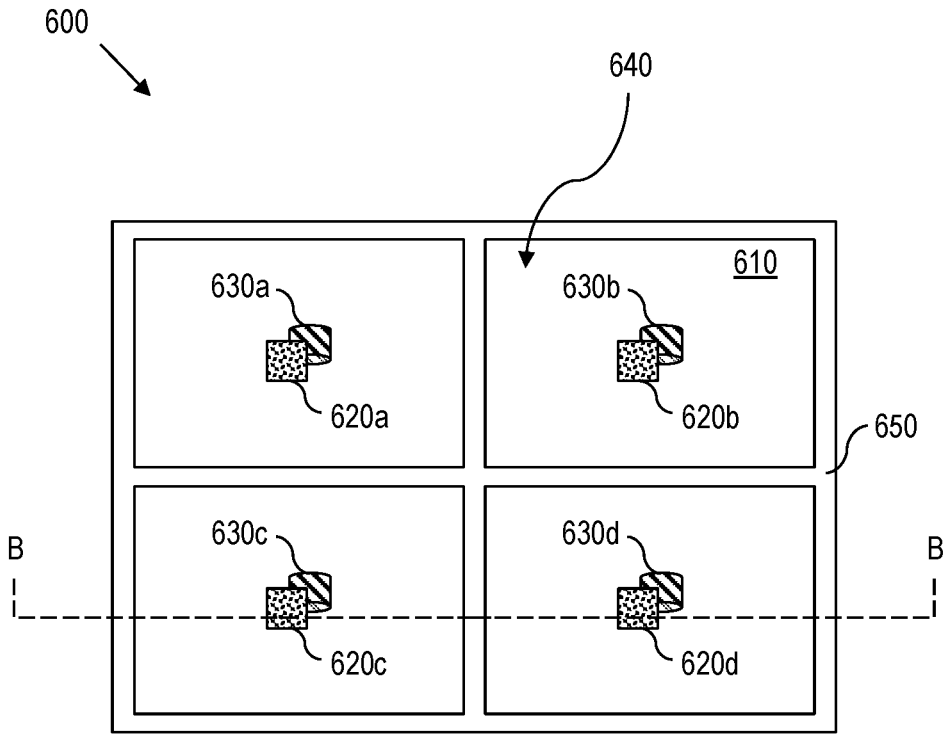
FIG. 6A is a diagram showing a top view of another embodiment of an apparatus that facilitates search and rescue.

FIG. 6A shows one embodiment of the apparatus 600 having a parabolic geometry (designated herein as a parabolic embodiment 600 for convenience). The parabolic embodiment 600 comprises a reflective substrate 610 with a substrate perimeter (shown in FIG. 6A as having a substrate geometry that is substantially square). When the parabolic embodiment 600 is deployed, the reflective substrate 610 forms a reflective parabolic surface or a reflective parabolic geometry with a focal point.

As shown in FIG. 6A, the number of parabolic surfaces can be increased by sub-dividing the reflective substrate 610 (e.g., four (4) separate parabolic surfaces are shown in FIG. 6A). Unlike the balloon embodiment 500 of FIG. 5, the parabolic embodiment 600 comprises activators 620*a*, 620*b*, 620*c*, 620*d* (collectively, 620) that are placed at the center of each sub-divided parabolic reflective surface 610, with each activator 620 being operatively coupled to its respective dye pack 630*a*, 630*b*, 630*c*, 630*d* (collectively, 630), each of which contains illuminable dye. A transparent cover 640 is placed atop the reflective substrate 610. Similar to the reflective substrate 610, the transparent cover comprises a cover geometry (also shown as being substantially square in FIG. 6A) and a cover perimeter that corresponds substantially with the substrate perimeter. An air-tight seal 650 is formed to seal the substrate perimeter to the cover perimeter to create a sealed internal region. For some embodiments, an air-tight seal 650 also separates each of the parabolic reflector sub-divisions (as shown in FIG. 6A).

Figure 6B:
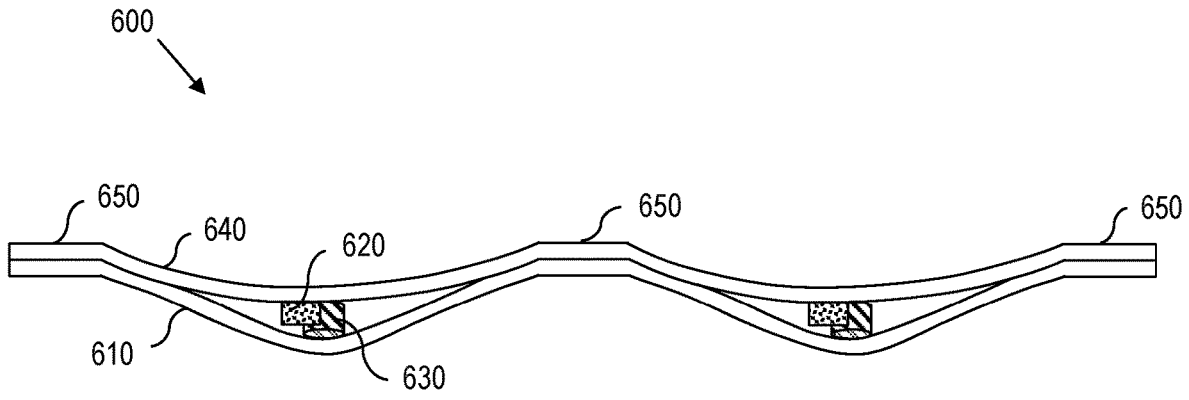
FIG. 6B is a diagram showing a side cut-away view of the apparatus of FIG. 6A prior to deployment of the apparatus.

Continuing to FIG. 6B, a cross section of the parabolic embodiment 600 (along the broken line B-B) prior to activation is shown. Unlike the balloon embodiment 500 of FIG. 5, the parabolic embodiment 600 affixes the activators 620 to the transparent cover 640 (using, for example, an adhesive or tape or other appropriate means), rather than to the reflective substrate 610. In other words, each activator 620 is located approximately at the focal point. The activators 620 are each located within its respective sealed internal region. Dye packs 630 (or breakable vessels) are each operatively coupled to its respective activator 620 (and, thus, also located within the corresponding sealed internal region). Unlike the balloon embodiment 500, which has a patterned array of activators 520 within the sealed area, each sealed internal region in the parabolic embodiment 600 comprises a single activator 620 that is located at the respective center of each of the sealed internal region.

Figure 6C:
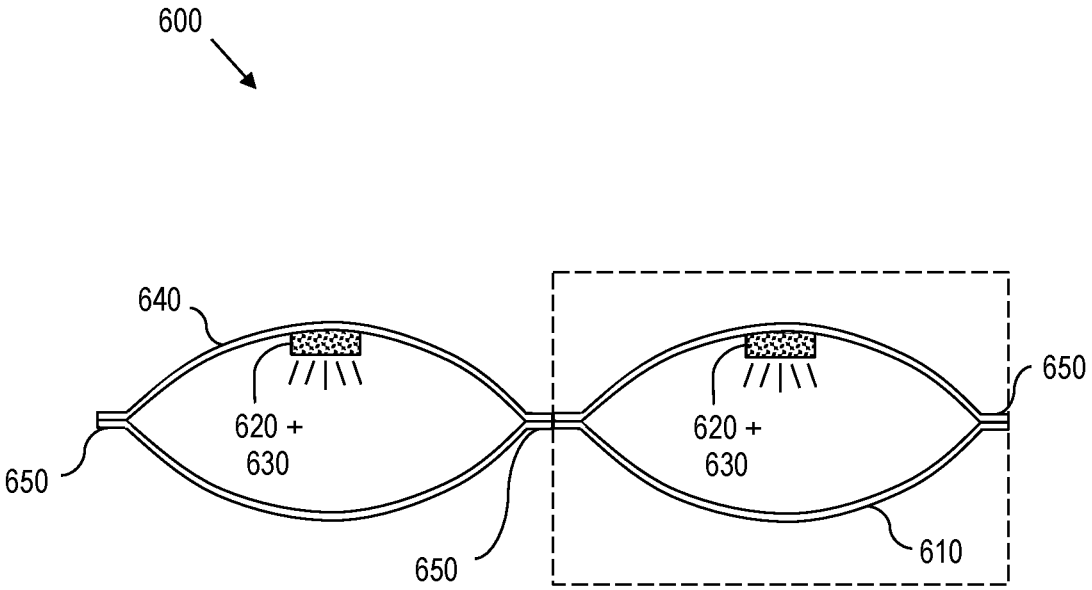
FIG. 6C is a diagram showing a side cut-away view of the apparatus of FIG. 6A upon deployment of the apparatus.

Continuing, FIG. 6C shows the parabolic embodiment 600 (along B-B) upon deployment. As noted above, each dye pack 630 is operatively coupled to its respective activator 620. Thus, upon breaking of the dye pack 630, the illuminable dye contained in each dye pack 630 is released and reacts promptly with its respective activator 620. The reaction between the illuminable dye and the activator 620 releases a gas that inflates the parabolic embodiment 600. Concurrent with the inflation, the combination of the activator 620 and the illuminable dye results in luminescence.

Figure 6D:
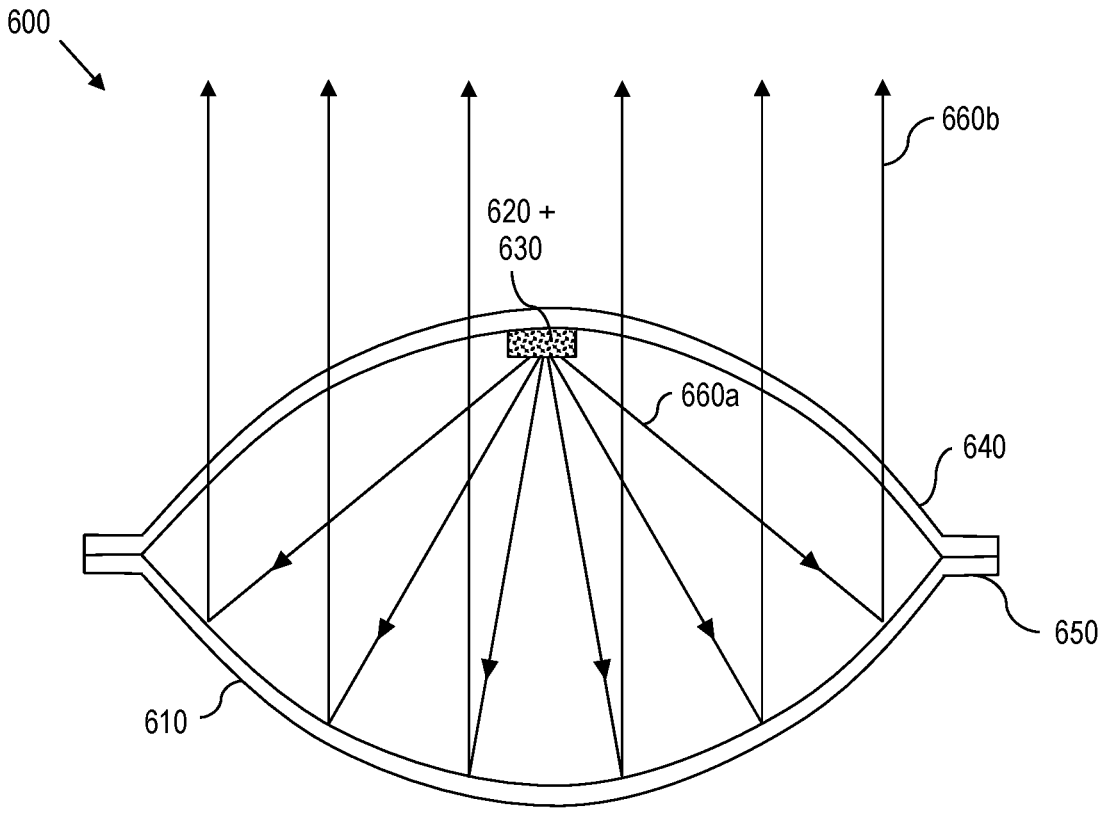
FIG. 6D is a diagram showing a focusing behavior of light in the apparatus of FIG. 6A.

Turning to FIG. 6D, which shows an enlarged view of one of the parabolic sub-divisions of FIG. 6A, when the parabolic embodiment 600 is deployed, the luminescent combination of the activator 620 and the illuminable dye separates from the reflective substrate 610 approximately to a focal point. It should be appreciated that the precise location of the focal point is dependent on many factors, such as the geometric shape of the reflective substrate 610, the geometric shape of the transparent cover 640, the size of each parabolic sub-division, the degree to which each parabolic sub-division inflates, etc. However, how to position the activator 620 on the transparent cover 640 prior to deployment so that the activator 620 becomes affixed at the parabolic focal point after deployment is a determination that can be done readily by those having skill in the art and, thus, further discussion of the placement of the activator 620 is omitted herein. What is significant for FIG. 6D is that the focal point be located on or near the transparent cover 640.

Continuing with FIG. 6D, when the combination of the activator 620 with the illuminable dye luminesces approximately at the focal point, the emitted light 660*a* (whether visible or UV or otherwise) is reflected from the reflective substrate 610 and emerges as collimated light 660*b*. The focused (and now collimated) light 660*b* has a greater concentrated intensity than the light from the balloon embodiment 500. Consequently, the parabolic embodiment 600 provides visibility from a greater distance than the balloon embodiment 500.

As shown in the embodiments of FIGS. 1 through 6, an individual is tethered to a deployable apparatus (through, for example, a tethering hole on the deployable apparatus). The deployable apparatus combines an illuminable dye with an activator, thereby increasing immensely the visibility of an individual in open water. The increased visibility facilitates maritime (or other open-water-based) search and rescue operations.

Although exemplary embodiments have been shown and described, it will be clear to those of ordinary skill in the art that a number of changes, modifications, or alterations to the disclosure as described may be made. For example, although an embodiment is shown in which the activator is located on the substrate and the illuminable dye is released from a breakable vessel, it should be appreciated that the illuminable dye can be located on the substrate, with the activator being released from the breakable vessel. Furthermore, although specific dimensions and chemical compositions are recited for clarity, it should be appreciated that the disclosed embodiments are not limited to only the recited dimensions or chemical compositions. Additionally, although the embodiments are described in the context of maritime search and rescue, those having skill in the art will understand that the increased visibility is beneficial in land-based operations or land-based environments. Also, those having skill in the art will appreciate that certain features of one embodiment can be implemented in other embodiments to realize advantages that are greater in combination than in isolation. All such changes, modifications, and alterations should therefore be seen as within the scope of the disclosure.

What is claimed is:

1. An environmentally isolated apparatus comprising:

a bottom substrate that is substantially impermeable to water, the bottom substrate comprising reflective material;

a pattern of activators positioned on the bottom substrate;

a breakable vessel; and illuminable dye located in the breakable vessel, the illuminable dye being sufficient to react with the pattern of activators, the pattern of activators for illuminating the illuminable dyes.

2. The apparatus of claim 1, the pattern being one that strikes a balance between optimized activation of the pattern of activators and optimized visibility.

3. The apparatus of claim 1, the pattern being a non-naturally occurring pattern.

4. An environmentally isolated apparatus comprising:

a bottom substrate that is substantially impermeable to water, the bottom substrate comprising reflective material;

a pattern of illuminable dyes located on the bottom substrate;

a breakable vessel located in the sealed internal region; and an activator located in the breakable vessel, the activator for illuminating the pattern of illuminable dyes.

5. The apparatus of claim 4, the pattern being one that strikes a balance between optimized activation of the pattern of activators and optimized visibility.

6. The apparatus of claim 4, the pattern being a non-naturally occurring pattern.

* * * * *